United States Patent [19]

Van Erden et al.

[11] Patent Number: 4,786,190

[45] Date of Patent: Nov. 22, 1988

[54] RECLOSABLE PACKAGE HAVING OUTER RECLOSABLE CLOSURE AND INNER NON-RECLOSABLE CLOSURE

[75] Inventors: Donald L. Van Erden, Wildwood; Hugo Boeckmann, Arlington Heights, both of Ill.

[73] Assignee: Minigrip, Inc., Orangeburg, N.Y.

[21] Appl. No.: 169,138

[22] Filed: Mar. 10, 1988

Related U.S. Application Data

[63] Continuation of Ser. No. 895,312, Aug. 11, 1986, abandoned.

[51] Int. Cl.[4] ..... B65D 33/18; B65D 33/20

[52] U.S. Cl. ..... 383/61; 206/260; 206/632; 383/66; 383/95

[58] Field of Search ..... 383/61, 66, 86, 95; 206/260, 632

[56] References Cited

U.S. PATENT DOCUMENTS

| | | | |
|---|---|---|---|
| 1,992,152 | 2/1935 | Yeates | 206/632 |
| 2,506,311 | 5/1950 | Moore | 206/632 |
| 2,560,535 | 7/1951 | Allen | 206/632 |
| 2,978,769 | 4/1961 | Harrah | 24/201 |
| 3,104,798 | 9/1963 | Stone | 383/86 |
| 3,172,443 | 3/1965 | Ausnit | 150/3 |
| 3,198,228 | 8/1965 | Naito | 150/3 |
| 3,313,471 | 4/1967 | Dickard et al. | 206/632 |
| 3,325,084 | 6/1967 | Ausnit | 229/77 |
| 3,326,399 | 6/1967 | Ausnit | 215/3 |
| 3,387,640 | 6/1968 | Butler | 383/86 |
| 3,456,867 | 7/1969 | Repko | 206/632 |
| 3,471,005 | 10/1969 | Sexstone | 206/632 |
| 3,473,589 | 10/1969 | Gotz | 150/3 |
| 3,543,343 | 12/1970 | Staller et al. | 18/14 |
| 3,625,270 | 12/1971 | Skendzic | 150/3 |
| 3,746,215 | 7/1973 | Ausnit et al. | 222/92 |
| 3,780,781 | 12/1973 | Uramoto | 150/3 |
| 3,991,801 | 11/1976 | Ausnit | 150/3 |
| 4,189,050 | 2/1980 | Jensen et al. | 206/632 |
| 4,191,230 | 3/1980 | Ausnit | 150/3 |
| 4,235,653 | 11/1980 | Ausnit | 156/91 |
| 4,241,865 | 12/1980 | Ferrell | 229/62 |
| 4,428,477 | 1/1984 | Cristofolo | 206/632 |
| 4,518,087 | 5/1985 | Goglio | 206/632 |

FOREIGN PATENT DOCUMENTS

| | | | |
|---|---|---|---|
| 2130173 | 5/1984 | United Kingdom | 383/94 |

*Primary Examiner*—Stephen P. Garbe

[57] ABSTRACT

A bag has wall panels defining a receptacle space and providing a bag mouth between upper end portions of the wall panels. A tamper evident, and if desired hermetic seal, non-reclosable closure located inwardly from a reclosable closure and located below upper ends of the upper end portions is accessible to be opened when the reclosable closure is open, and the reclosable closure is arranged for interim opening and closing of the bag. The non-reclosable closure may be a peel seal or a tear line. The reclosable closure may be formed from pressure sensitive adhesive.

5 Claims, 1 Drawing Sheet

RECLOSABLE PACKAGE HAVING OUTER RECLOSABLE CLOSURE AND INNER NON-RECLOSABLE CLOSURE

This is a continuation of application Ser. No. 895,312, filed Aug. 11, 1986 now abandoned.

BACKGROUND OF THE INVENTION

This invention relates in general to the packaging art, and is more particularly concerned with reclosable bags.

Numerous and varied reclosable bag structures have been proposed, and some have proven to be commercially quite good.

In particular, there has been some emphasis on providing tamper evident bags, and bags that are hermetically sealed until they are opened for access to the contents, whereafter a reclosable fastener device comes into play for maintaining the contents within the bag until access is again desired. By way of example, attention is directed to the following U.S. Patents as representative of various approaches to the type of bag with which the present invention relates by way of improvement:

U.S. Pat. Nos. 2,978,769 and 3,172,443 disclose nonreclosable frangible connections of fastener profiles.

U.S. Pat. No. 3,325,084 discloses a closure flap provided with closure profiles that will meet with closure profiles on the front of the bag or package.

U.S. Pat. No. 3,326,399 discloses the use of magnetic reclosable fastening means.

U.S. Pat. Nos. 3,198,228; 3,473,589 and 3,780,781 disclose reclosable profile fasteners or zippers, and a tear off top on the bag for access to the zipper.

U.S. Pat. No. 3,543,343 discloses a bag with reclosable fastener profiles and a tear cord for opening the bag.

U.S. Pat. No. 3,625,270, discloses a tear ribbon device for opening the bag.

U.S. Pat. No. 3,746,215, discloses a funnel arrangement which retains the bag sealed closed until the funnel is everted and the end snipped off.

U.S. Pat. Nos. 3,991,801; 4,191,230 and 4,235,653, disclose other arrangements of funnel bags.

U.S. Pat. No. 4,241,865, discloses a heavy duty bag to be made from paper and equipped with a primary rip cord closure and a hood thereover provided with a reclosable zipper of the interlocking teeth type.

In spite of the fairly high state of development in this art, there is still room for improvement and the attainment of simplicity and economy in dual fastener bags, that is, bags that have hermetic or at least tamper evident non-reclosable closure means and associated reclosable closure means.

SUMMARY OF THE INVENTION

An important object of the present invention is to provide a new and improved bag or package structure having nonreclosable closure means which is readily digitally openable when associated reclosable closure means are in an open condition, the bags being reclosable by means of the latter closure means To the attainment of that object, the present invention provides a bag having opposed wall panels secured together at a bottom end and at opposite sides, and comprising a bag mouth defined by and between upper end portions of the wall panels, reclosable closure means located substantially below the upper ends of the upper end portions of and responsive to digital closing pressure for attaining a closed condition of the reclosable closure means for closing the mouth, the reclosable closure means being openable responsive to digital pullapart force for opening the bag mouth to gain access into the bag, there being non-reclosable closure means located inwardly relative to the reclosable closure means for initially maintaining the bag mouth closed independently of the reclosable closure means and the non-reclosable closure means being openable by pullapart force when the reclosable closure means is open.

BRIEF DESCRIPTION OF THE DRAWINGS

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
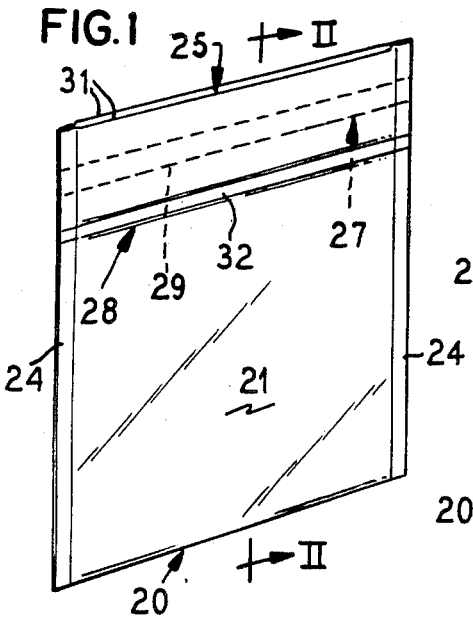
FIG. 1 is a perspective view of a bag structure embodying the invention.
Figure 2:
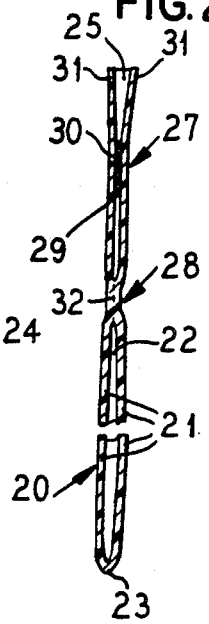
FIG. 2 is a fragmental vertical sectional detail view taken along the line II—II in FIG. 1.

Referring to FIGS. 1 and 2, a package or bag 20 has opposed wall panels 21 providing a receptacle space 22. The panels 21 are secured together at a bottom end 23 such as by means of a fold in the material from which the wall panels 21 are made; or by a seam if the panels 21 have been or are formed as separate sheets. Opposite sides of the panels are secured together as by means of heat seal seams 24 where the bag material lends itself to such sealing, as where the material is of well known plastic film which may be either monofilm or laminate, depending upon the use to which the bag is to be put. Where the material is not susceptible of fused sealing, adhesive securement may be effected.

By and between their upper end portions, the bag wall panels 21 define a bag mouth 25 through which access may be had into the receptacle space 22, after reclosable closure means 27 located at the upper end portions of the wall panels 21, and non-reclosable closure means 28 located inwardly from the reclosable closure means 27, have been opened.

In one desirable form, the reclosable fastener means 27 may comprise a stripe of pressure sensitive adhesive 29 which is permanentaly secured to one of the wall panels 21 and has an adherent surface 30 which is releasably engagable with the other of the wall panels 21. As shown, the reclosable fastener stripe 29 extends entirely across the mouth from side-to-side so that when this fastener is closed, the bag mouth 25 is substantially thoroughly closed against ingress or egress relative to the pouch 22. However, when it is desired to open the fastener 27, digital engagement of the upper ends of the side wall panels 21, serving as pull flanges 31, and pulling them apart will pull the fastener surface 30 away from the engaged wall panel and thus open the bag mouth 25. Digital pressure to press the upper portions of the wall panels 21 together in line with the fastener 27 will cause the fastener surface 30 to readhere releasably to the confronting wall panel area and, thus, close the bag mouth 25.

As to the non-reclosable fastener 28, it preferably comprises a peel seal 32 wherein the confronting inside face areas of the wall panels 21 are heat sealed in a fashion to effect a face-to-face peel seal. Such seal is not a permanent seal, but a seal that can be opened, that is, peeled open or apart by pullapart force applied to the upper end portions of the wall panels 21, after gaining access through the opened reclosable seal 27. Thereafter, the peel seal 28 remains open, but the bag can be reclosed by means of the reclosable seal 27.

Figure 3:
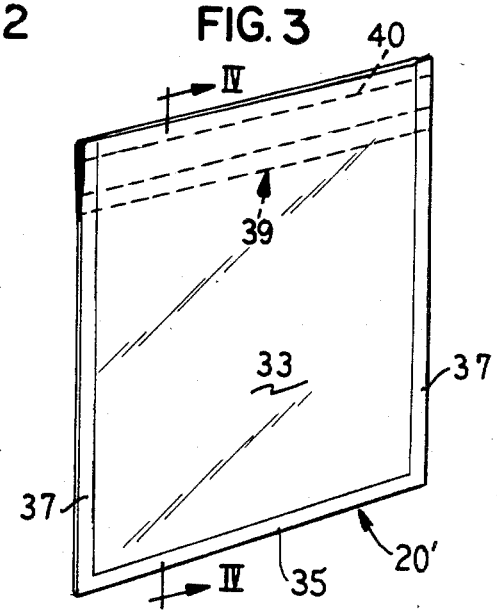
FIG. 3 is a perspective view of a modified bag structure embodying the invention.
Figure 4:
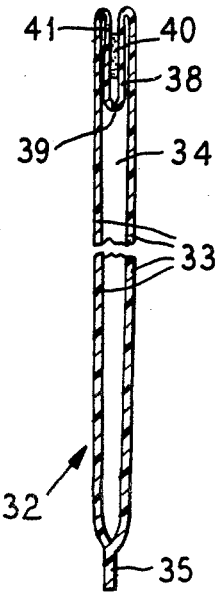
FIG. 4 is a vertical fragmental sectional detail view taken substantially along the line IV—IV in FIG. 3.

A bag 20' as shown in FIGS. 3 and 4 comprises opposed wall panels 33 providing a receptacle space 34. At their bottom ends, the panels 33 are secured together as by means of a heat seal 35. Opposite sides of the panels are secured together as by means of heat seal seams 37. Of course, if the material of the wall panels 33 is not susceptible of heat sealing, the closure seams 35 and 37 may be effected by adhesive means.

At the upper or mouth end of the bag 20', the panels 33 are connected together by means of an integral inwardly projecting fold 38 which is secured at its opposite ends to the upper end portions of the side seal seams 37. Along its inner edge, the fold 38 is provided with non-reclosable closure means 39 in the form of a line of weakening such as perforations which extend throughout the length of the fold. Reclosable closure means 40 are provided by a stripe of pressure sensitive adhesive, which is permanently secured to one of the wall surfaces within the fold 38 and has an adherent surface 41 which is releasably engagable with the opposing inner wall surface of the fold. The adhesive stripe 40 desirably extends throughout the length of the fold 38.

When it is desired to open the bag 20', digital pullapart force applied to the upper or outer edges of the fold 38 where they integrally join the upper ends of the wall panels 33 will pull the fastener surface 41 away from the engaged fold wall and thus open the fastener 40. By additional pullapart force applied to the now opened fold 38, the non-reclosable seal line of weakening or perforation line 39 is separated for gaining full access into the bag pouch 34. Then, when it is desired to reclose the bag, digital pressure applied to the upper end portions of the bag walls 33 and toward the fastener 40 will cause the fastener 40 to reclose the bag mouth by releasably adherent engagement of the fastener surface 41 with the confronting inwardly projecting wall of the fold 38.

Figure 5:
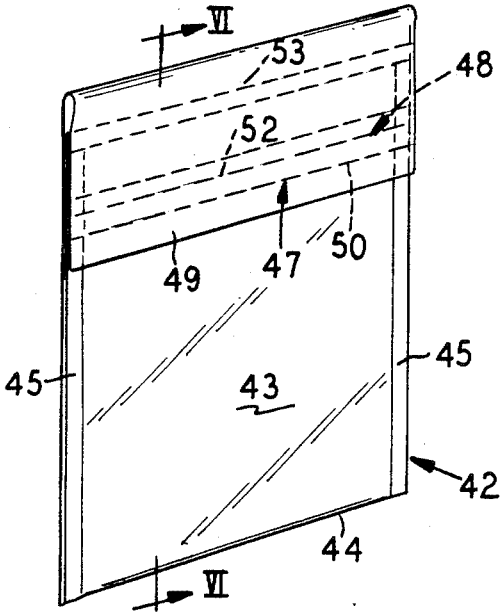
FIG. 5 is a perspective view of still another modified bag structure embodying the invention.
Figure 6:
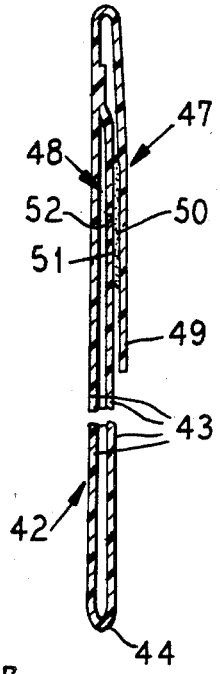
FIG. 6 is a vertical fragmental sectional detail view taken substantially along the line VI—VI in FIG. 5.
Figure 7:
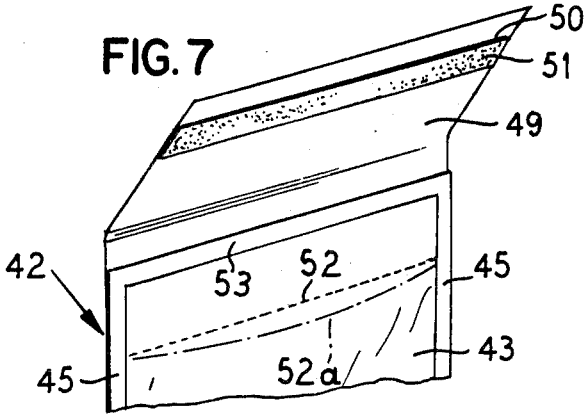
FIG. 7 is a perspective view of the upper portion of the bag of FIGS. 5 and 6 showing the reclosable fastener means in the open condition.

In a bag 42 as shown in FIGS. 5–7, opposed wall panels 43 are, similarly as in FIGS. 1 and 2, formed from a folded sheet or separate sheets wherein the panels 43 are secured together by means of a bottom fold 44 and are secured together at the sides of the bag by means of seal seams 45, which may be heat seals or adhesive seals, as the case may be. Upper end portions of the wall panels 43 provide bag mouth structure including reclosable closure means 47 and non-reclosable closure means 48. In this instance, the reclosable closure means 47 comprises a flap 49 extending across the width of the bag 42 and formed as an extension from the top end of one of the wall panels 43 and bent down overlapping the outer face of the other of the wall panels 43. Carried by the inner face of the flap 49 is digital pressure responsive means 50 in the form of a stripe of pressure sensitive adhesive extending across the width of the flap 49 and having an adherent surface 51 which is separably, i.e., releasably, but reclosably engagable with the wall panel 43 when such wall panel is overlapped by the flap 49

The non-reclosable closure means 48 conveniently comprises a transverse line 52 of weakening, desirably perforations, extending across the upper portion of the overlapped wall panel 43 so that the line 52 is concealed by the flap 49 in the closed condition of the flap. Desirably, the weakening line 52 is disposed in alignment with the reclosable closure means adhesive 50. Above the non-reclosable closure weakening line 52, the panel 43 having such line is desirably permanently fixedly secured as by means of heat sealing or adhesive 53 t the contiguous face of the other of the wall panels 43. Thereby, the only way in which access can be gained into the bag 42 is by breaking the weakened line non-reclosable closure means 52. Thereafter, the opening provided by breaking the line 52 can be closed by the reclosable closure means 47, the slit opening at the opened weakened line 52 being reclosably closed by means of the adhesive stripe 50, thus avoiding unintentional spillage from or intrusion into the bag 42.

Normally, the closure flap 49 will be retained in place by the adhesive stripe 50. When it is desired to gain access into the bag 42, the distal or free terminal end portion of the flap 49 is adapted to be grasped digitally and the reclosable closure 47 pulled open from the closed position shown in FIGS. 5 and 6 into the open position in FIG. 7. This exposes the non-reclosable closure 48 which can be readily ripped open by digital manipulation for opening a mouth opening 52*a*. Interim closing of the opening now provided at 52 can then be readily effected by moving the closure flap 49 into the closing position and applying digital pressure to effect releasable adherence of the reclosable closure stripe 50 with the bag wall inwardly relative to the reclosable closure means 47.

Figure 8:
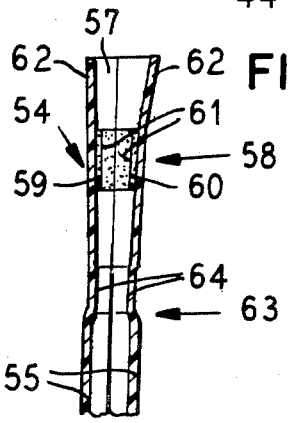
FIG. 8 is a fragmentary vertical sectional detail view showing the upper portion of a bag similar to the bag of FIGS. 1 and 2, but with a modified reclosable fastener structure.

In FIG. 8, is shown a bag 54 which is much the same as the bag 20 in FIG. 1, having wall panels 55 which are secured together at the bottom and side edges, but are not permanently secured together at their upper end portions where a bag mouth 57 is provided. Reclosable closure means 58 in this instance comprise a stripe of pressure sensitive adhesive 59 permanently attached to and extending across the inside surface of one of the wall panels 55 and a similar stripe of pressure sensitive adhesive 60 permanently secured to and extending across the inside surface of the other of the wall panels 55. The adhesive stripes 59 and 60 are aligned so that by applying digital pressure on the outside surfaces of the wall panels 55 in line with the stripes 59 and 60, respective releasably adherent surfaces 61 on the adhesive stripes will engage with sufficient adherence to retain the bag mouth 57 temporarily closed. The bag mouth 57 can be readily opened by pullapart digital force on pull flanges 62 provided by the upper portions of the wall panels 55 above the reclosable closure 58.

Non-reclosable closure means 63 for the bag 54 comprises a peel seal 64 across the upper portion of the bag 54 and located inwardly relative to the reclosable closure means 58. The peel seal 64 corresponds to the peel seal 32 in FIGS. 1 and 2, and is adapted to be openable, that is peeled open, by pullapart force applied through the pull flanges 62 after the reclosable closure means 58 has been opened.

From the foregoing, it will be appreciated that in all forms of the invention the non-reclosable closure means provides a tamper evident device. Throughout, the digitally reclosable closure means is located substantially below the upper ends of the upper end portions of the bag wall panels, in an advantageous arrangement enabling the upper end portions to be conveniently manipulated for pullapart opening of the bag.

Certain of the non-reclosable closures assist in hermetically sealing the associated bags. After any form of the non-reclosable closure means has been opened it will be apparent that access has been gained or attempted to be gained into the bag. Inspection as to whether there has been tampering with the non-reclosable closure means can be easily effected. The reclosable closure means must be opened in order to gain access to the non-reclosable closure means. After the non-reclosable closure means has been opened, interim closing of the bag is effected by reclosing the reclosable closure means.

It will be understood, of course, that full closure of the pouches provided by the bags will be effected after the bags have been filled. For instance, where it is desired to fill the bags through their upper or mouth ends, the peel seal non-reclosable closure means may be closed after the filling. On the other hand, it may be desired to fill the bags through an open side or an open bottom which is sealed after the filling has been accomplished, and in such case the non-reclosable closure means may be closed before filling. From the various forms of non-reclosable and reclosable closure means disclosed, it will be apparent that various appropriate combinations thereof may be chosen for various particular needs.

It will be understood that variations and modifications may be effected without departing from the spirit and scope of the novel concepts of the present invention.

We claim as our invention:

1. A bag having opposed wall panels secured together and defining a receptacle space therebetween, and comprising:

a bag mouth defined between upper end portions of said wall panels which extend between opposite sides of the bag;

a one-time openable non-reclosable peel seal closure extending in a narrow band from side-to-side of the bag and securing said panels together substantially below the upper ends of said upper end portions and initially maintaining said mouth fixedly closed;

a reclosable closure means located below said upper ends of said upper end portions, but above said peel seal and functioning for initially maintaining said upper end portions against access to said non-reclosable peel seal closure, and being adapted to be manually pulled open and reclosed for selectively opening and closing said mouth after said non-reclosable peel seal closure has been opened;

said reclosable closure means being openable responsive to digital pullapart force applied to said upper end portions of the wall panels for gaining access to said non-reclosable peel seal closure; and said non-reclosable peel seal closure being openable by continuing pullapart force applied to said upper end portions after said reclosable closure means has been pulled open for gaining complete access into said receptacle space, and said reclosable closure means being thereafter reclosably closable as the sole closure for the bag mouth.

2. A bag according to claim 1, wherein said reclosable closure means comprises pressure sensitive adhesive.

3. A bag having opposed wall panels secured together and defining therebetween a receptacle space, and comprising:

one of said wall panels having an upper end to which is attached one end of an extension flap which projects substantially beyond an adjacent upper end of the other of said wall panels;

means fixedly securing said upper end of said other wall panel to said upper end of said one wall panel along said one end of said extension flap;

means providing for a bag mouth access opening through said other of said wall panels below said fixedly securing means;

said extension flap being of a length to extend downwardly for overlappingly engaging said other wall panel to a point substantially below, and in closing relation to, said access opening means;

a reclosable closure comprising pressure sensitive adhesive for retaining said extension flap in closing relation to said access opening means, so that said extension flap must be released by opening of said reclosable closure means and swung away from said other wall panel to clear said access opening means to gain open mouth access therethrough to said receptacle space; and said pressure sensitive adhesive being aligned with said access opening means for sealing the access opening means in cooperation with said extension flap when said extension flap is in engagement with said other of said wall panels.

4. A bag according to claim 3, wherein said access opening means comprises a line of weakening extending across said other panel, and which line of weakening must be ruptured to provide a mouth slit for gaining said open mouth access into said receptacle space.

5. A bag according to claim 4, wherein said pressure sensitive adhesive is carried on said extension flap and the adhesive overlies said access opening means and provides releasable closure for said opening after rupture of said line of weakening when the extension flap overlies said other wall panel.

* * * * *